US009427035B2

(12) United States Patent
Coll et al.

(10) Patent No.: US 9,427,035 B2
(45) Date of Patent: Aug. 30, 2016

(54) TATTOO-REVEALING GARMENT

(71) Applicant: Tattees, LLC, Cheyenne, WY (US)

(72) Inventors: Rebecca Coll, Glen Rock, NJ (US); Carmen Milagro Gonzalez, San Francisco, CA (US)

(73) Assignee: TATTEES, LLC, Cheyenne, WY (US)

( * ) Notice: Subject to any disclaimer, the term of this patent is extended or adjusted under 35 U.S.C. 154(b) by 0 days.

(21) Appl. No.: 14/512,096

(22) Filed: Oct. 10, 2014

(65) Prior Publication Data

US 2015/0128326 A1 May 14, 2015

Related U.S. Application Data

(60) Provisional application No. 61/903,157, filed on Nov. 12, 2013.

(51) Int. Cl.

| | |
|---|---|
| ***A41D 27/10*** | (2006.01) |
| ***A41D 27/08*** | (2006.01) |
| ***A41D 1/04*** | (2006.01) |
| *A41D 27/00* | (2006.01) |

(52) U.S. Cl.

CPC ..... *A41D 27/08* (2013.01); *A41D 1/04* (2013.01)

(58) Field of Classification Search

CPC .. D06M 23/18; D06M 23/16; D06M 15/693; D06M 2200/40; D06M 23/00; D06M 7/00; A41H 43/00; A41D 27/245; A41D 13/0015; A41D 2400/24; Y10T 428/269; Y10T 428/1362; Y10T 428/1321; Y10T 428/31663; Y10T 442/2139; Y10T 442/3016; Y10T 442/3553; Y10T 442/3854; Y10T 428/1352; Y10T 428/24777; Y10T 428/24802; Y10T 428/2962; Y10T 442/2369; Y10T 442/277; Y10T 442/2861; A41B 2400/38; A41C 5/00; B29C 63/00; D03D 1/02

See application file for complete search history.

(56) References Cited

U.S. PATENT DOCUMENTS

| | | | | |
|---|---|---|---|---|
| 3,828,368 | A | 8/1974 | Lam | |
| 3,900,633 | A * | 8/1975 | Piron | 428/204 |
| 4,196,033 | A * | 4/1980 | Arai et al. | 156/196 |
| 4,501,024 | A | 2/1985 | Russo | |
| 4,813,081 | A | 3/1989 | Cliff et al. | |
| 5,090,056 | A | 2/1992 | Stoner et al. | |
| 5,285,725 | A * | 2/1994 | Imamaki et al. | 101/127.1 |
| 5,347,658 | A | 9/1994 | Clark | |
| 5,515,542 | A | 5/1996 | Simmons | |

(Continued)

OTHER PUBLICATIONS

Tricia, "Thumb hole? Or Tattoo Window?" The Chicka Blog, entry dated Jan. 13, 2011. Internet. Available at http://pachickster.blogspot.com/2011/01/thumb-hole-or-tattoo-window.html Last visited Aug. 22, 2011.

(Continued)

*Primary Examiner* — Bobby Muromoto, Jr.

(74) *Attorney, Agent, or Firm* — PatentBest; Andrew McAleavey

(57) ABSTRACT

Disclosed are garments that reveal body art and methods for wearing these garments. The garments have one or more tattoo-revealing windows or openings in them. Each of the windows or openings has a border around its underside. The border is comprised of a silicone ink which may be deposited on the garment by, e.g., screen printing. The method of wearing a tattoo-revealing garment includes wearing the garment such that the opening or window is centered on a piece of body art and is maintained in place by the border of silicone ink. The garment may be sold as a part of a kit that also includes a piece of temporary body art.

20 Claims, 5 Drawing Sheets

(56) References Cited

U.S. PATENT DOCUMENTS

| | | | | |
|---|---|---|---|---|
| 5,960,476 | A * | 10/1999 | Danzy | 2/115 |
| 5,970,516 | A | 10/1999 | Shimooka | |
| 6,038,702 | A | 3/2000 | Knerr | |
| 6,044,492 | A * | 4/2000 | Krogh | 2/115 |
| 6,067,660 | A * | 5/2000 | Contini | 2/246 |
| 6,175,960 | B1 * | 1/2001 | Knittel | 2/115 |
| 6,473,908 | B1 | 11/2002 | Bontems | |
| 6,526,587 | B1 * | 3/2003 | Jeziak et al. | 2/69 |
| 6,526,589 | B1 * | 3/2003 | Jeziak et al. | 2/69 |
| 6,769,139 | B1 * | 8/2004 | Goldkind | 2/247 |
| 6,820,281 | B2 * | 11/2004 | Mariland et al. | 2/115 |
| 7,003,810 | B2 * | 2/2006 | Goldkind | 2/227 |
| D542,008 | S | 5/2007 | Bouaziz | |
| D545,029 | S | 6/2007 | Redwine | |
| D574,286 | S | 8/2008 | Rose et al. | |
| 7,454,856 | B2 * | 11/2008 | Passman | 40/661.04 |
| D612,131 | S * | 3/2010 | Brown et al. | D2/840 |
| D638,203 | S | 5/2011 | Nehemiah et al. | |
| D642,358 | S | 8/2011 | White | |
| 8,181,274 | B1 * | 5/2012 | Prince et al. | 2/115 |
| 8,453,265 | B2 * | 6/2013 | Forte et al. | 2/115 |
| D717,019 | S * | 11/2014 | van Dalen | D2/717 |
| 8,898,817 | B1 * | 12/2014 | Morales et al. | 2/250 |
| 2002/0124742 | A1 * | 9/2002 | Tebbe | 101/129 |
| 2003/0134066 | A1 * | 7/2003 | Keshavaraj et al. | 428/36.1 |
| 2004/0232682 | A1 * | 11/2004 | Keshavaraj et al. | 280/743.1 |
| 2005/0060784 | A1 * | 3/2005 | Emeth | 2/93 |
| 2005/0233137 | A1 * | 10/2005 | Angelino et al. | 428/339 |
| 2006/0059600 | A1 * | 3/2006 | Emeth | 2/93 |
| 2006/0122323 | A1 * | 6/2006 | Dumont et al. | 524/862 |
| 2007/0128407 | A1 * | 6/2007 | Kerr | 428/138 |
| 2007/0204782 | A1 * | 9/2007 | Angelino et al. | 112/475.09 |
| 2007/0294806 | A1 | 12/2007 | Harazi | |
| 2008/0134552 | A1 | 6/2008 | Lough | |
| 2008/0207827 | A1 * | 8/2008 | Dumont et al. | 524/588 |
| 2008/0295227 | A1 * | 12/2008 | Welsch et al. | 2/401 |
| 2009/0025869 | A1 * | 1/2009 | Hill | 156/250 |
| 2009/0047481 | A1 * | 2/2009 | Welsch et al. | 428/179 |
| 2009/0113597 | A1 * | 5/2009 | Norris et al. | 2/69 |
| 2010/0100024 | A1 * | 4/2010 | Reid, Jr. | 602/63 |
| 2011/0099679 | A1 | 5/2011 | Na | |
| 2012/0272430 | A1 * | 11/2012 | Angelino et al. | 2/69 |
| 2013/0212767 | A1 * | 8/2013 | Nordstom et al. | 2/69 |

OTHER PUBLICATIONS

No author listed, "Pictures: Embossed with US Army in Afghanistan" India and World News You Could Use, entry dated Aug. 3, 2009. Internet. Available at http://indianewsfreak.wordpress.com/2009/08/03/pictures-embedded-with-us-army-in-afghanistan/ Last visited Aug. 22, 2011.

Daily Mail Reporter, "Miley Cyrus Continues Her Rebellious Streak with a FIFTH Tattoo" Mail Online, Article dated Feb. 4, 2011. Internet. Available at http://www.dailymail.co.uk/tvshowbix/article-1353163/Miley-Cyrus-continues-rebellius-streak-FIFTH-tattoo.html Last visited Aug. 22, 2011.

Lauren Davis, "Here is the Male Version of Power Girl's Boob Window (NSFW)" io9, article dated Apr. 18, 2014, Internet. Available at http://io9.com/here-is-the-male-version-of-power-girls-boob-window-1564780945 Last visited Oct. 9, 2014.

No author listed, "5 Excuses for Power Girl's 'Boob Window'" Buzzfeed, article dated Jul. 15, 2013, Internet. Available at http://www.buzzfeed.com/spartantown/5-excuses-for-power-girls-boob-window-c8u6 Last visited Oct. 9, 2014.

* cited by examiner

TATTOO-REVEALING GARMENT

BACKGROUND OF THE INVENTION

1. Field of the Invention

In general, the invention relates to garments and apparel, and more particularly, to garments that reveal tattoos.

2. Description of Related Art

Body art, once a niche practice, has become more popular in recent years. The most common form of body art is the tattoo, in which indelible inks are injected into the dermal layer of the skin, permanently coloring it. The process of creating a tattoo requires a degree of artistic skill, and can be time-consuming as well as painful for the person being tattooed.

In some cultures, tattoos signify group membership, position, or importance, and are given or received in connection with particular rites of passage. Even in cultures that do not associate tattoos with particular rituals, tattoos are often chosen for deeply personal reasons.

For those who do not seek the permanence of a true tattoo, so-called "temporary" tattoos can be created in any number of ways. One of the more popular forms of temporary tattoo is the ink transfer temporary tattoo, where a wetted film with a pre-printed design is pressed to the skin, causing the ink to transfer from the film to the skin. Some ink transfer temporary tattoos have layers of glue or other elements intended to protect the design and keep it on the skin longer. Ink transfer temporary tattoos are popular and common because they can be mass-produced and offer predictable performance. Placed properly and well, an ink transfer temporary tattoo may last about 3-5 days.

Temporary tattoos may also be produced by applying henna or airbrushing inks onto the surface of the skin. These types of temporary tattoos can be more intricate, detailed, and personal than ink transfers, although they may require just as much artistic skill and just as much time to create as permanent tattoos.

Whether temporary or permanent, those with tattoos often want to display them. Displaying a tattoo is easy if the tattoo is in a location that is usually not covered by clothing, like the forearm. However, tattoos on the chest and back, for example, are harder to display without exposing the entire torso.

Over the years, a number of garments have been developed that include openings or windows that are meant to expose tattoos without exposing the rest of the body. U.S. Patent Application Publication No. 2009/0113597 reflects one of the more recent attempts and discloses garments with strategically placed holes to reveal tattoos.

In general, these sorts of garments have a number of potential problems. For one, the openings or windows may not be finished with stitching, piping, or anything else around their edges, which leaves the opening to fray around the edges. Also, as the garment moves against the body, the opening or window may not stay in place, and may move in a way that causes it to obscure the tattoo it is meant to showcase.

SUMMARY OF THE INVENTION

One aspect of the invention relates to tattoo-revealing garments. The tattoo-revealing garments include at least one tattoo-revealing window. The tattoo-revealing window has a border around it on the underside of the garment's fabric, facing the skin of the wearer. The border is made of a silicone ink that is deposited out to some distance from the window, for example, by screen printing. The border may help the window to stay in position on the skin.

Another aspect of the invention relates to methods of making tattoo-revealing garments. These methods include depositing a silicone ink, for example, by screen printing, in a border pattern around an area where a window is to be formed and then forming the window by laser cutting through the material.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the drawings, and in which.

DETAILED DESCRIPTION

Figure 1:
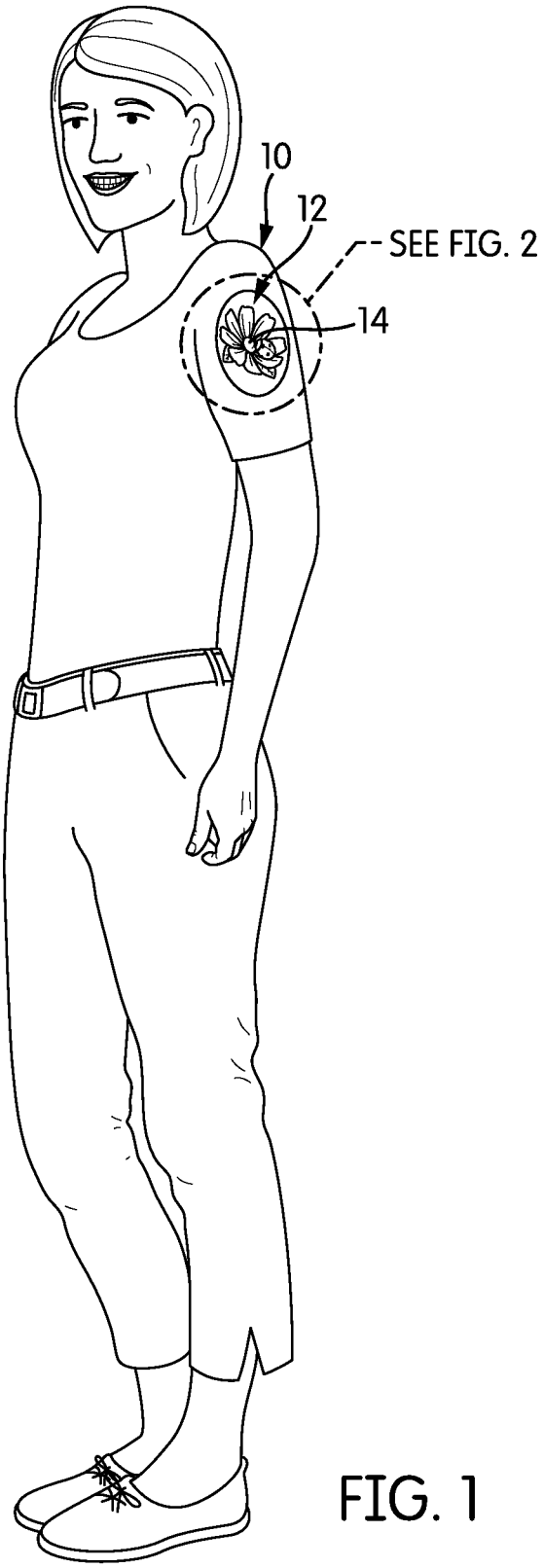
FIG. 1 is a perspective view of a tattoo-revealing garment, as worn by a person.

FIG. 1 is a perspective view of a tattoo-revealing garment, generally indicated at 10, according to one embodiment of the invention. In the illustrated embodiment, the garment 10 is a t-shirt, although as will be described below in more detail, garments according to embodiments of the invention may be of any type, including jeans, slacks, and garments for children such as leggings and knee socks.

Figure 2:
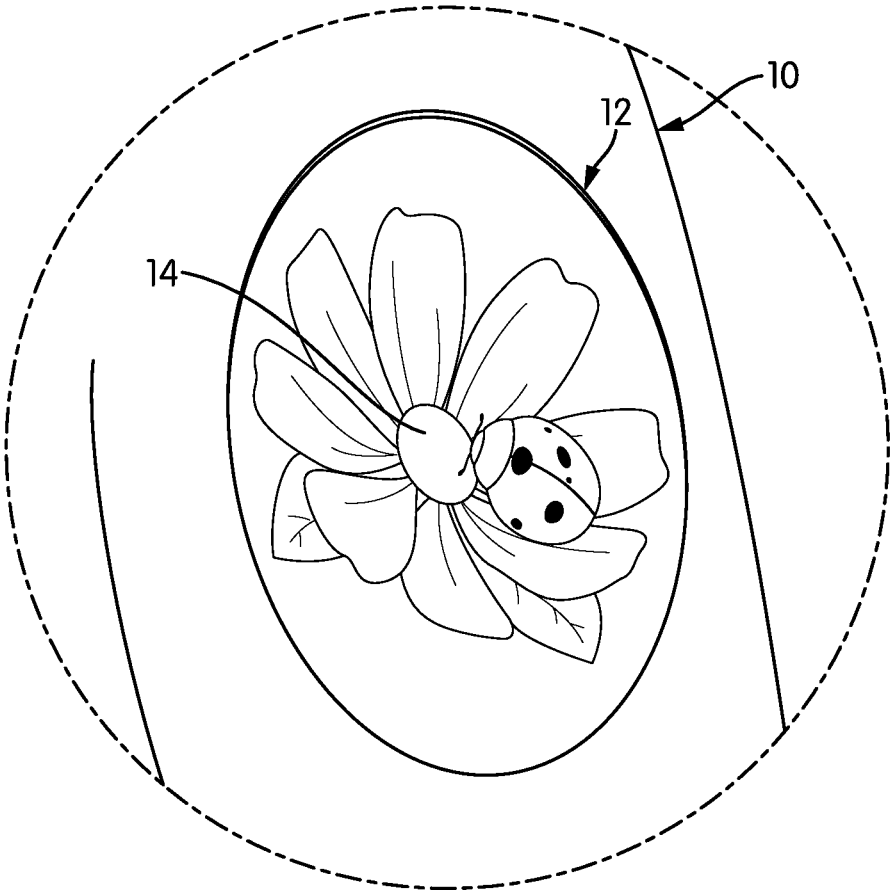
FIG. 2 is a perspective view of a portion of the tattoo-revealing garment.

FIG. 2 is a perspective view of the sleeve portion of the garment 10. As shown in FIGS. 1 and 2, the garment 10 has at least one window 12 that is positioned to expose a tattoo 14. The tattoo 14 may be a permanent tattoo or a temporary tattoo, such as an ink transfer tattoo. The window 12 is a break in the material of the garment 10 that is open to the skin to reveal a tattoo 14 on the skin. The window 12 may be in essentially any location on the garment 10, so as to facilitate display of tattoos 14 in essentially any location, and there may be more than one window 12 per garment. In the illustration of FIG. 1, the window 12 is on the sleeve. Other suitable locations for a window 12 may include centered on the upper chest or above the left or right breast.

Garments 10 may be made in different varieties with windows 12 provided in the most common locations for tattoos. However, garments 10 may also be sold along with temporary tattoos 14 that can be applied on the skin at the location of the window 12 once the garment 10 is in place.

Figure 3:
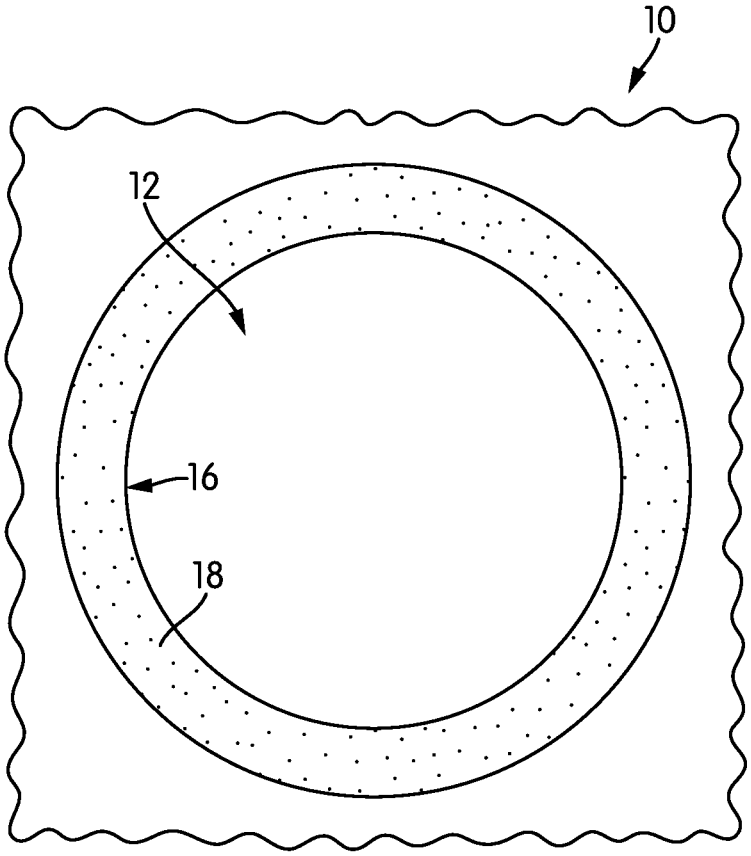
FIG. 3 is a plan view of the underside of a portion of the tattoo-revealing garment.
Figure 4:
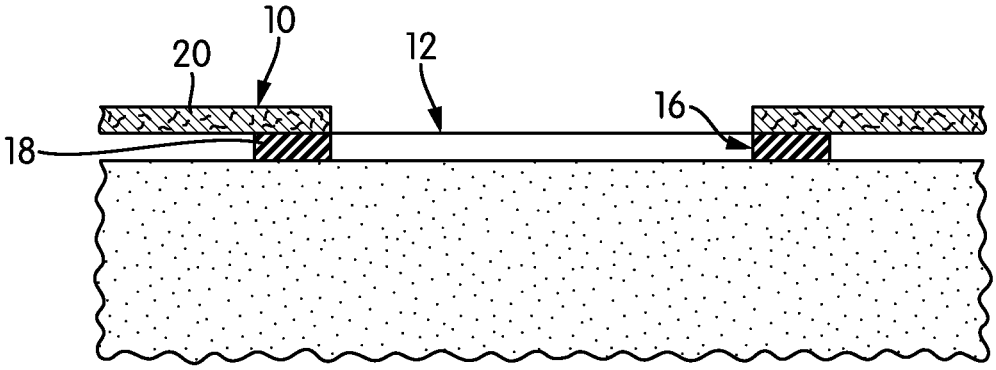
FIG. 4 is a cross-sectional view of the garment around its tattoo-revealing window.

FIG. 3 is a plan view of the underside (i.e., the skin-facing side) of the window 12, and FIG. 4 is a cross-sectional view of the garment 10 around the window 12. The present inventors have found that a silicone ink applied around the border of the window 12 by a screen printing process surprisingly serves two beneficial functions, it serves to prevent the edges of the fabric from unraveling, and it provides some grip or increased friction against the underlying skin, which, in turn, helps the window 12 to stay in place.

As shown, the inked border area 16 extends to the edge of the window 12 and some distance around it. The inked border area 16 may extend from about 0.125 inches to about 0.5 inches out from the edge of the window 12, with an average of about 0.25 inches. Larger windows 12 may require thicker border areas 16, while relatively small windows 12 may use thinner border areas 16. The location of the window 12 in the garment may also influence the size of a border area 16, with areas of the garment 10 that have less skin contact requiring thicker border areas 16.

The layer of ink 18 is generally continuous and is typically thin, in most embodiments about the thickness of a typical screen-printed pattern. For example, the ink may be printed at a thickness of between 1-2 mm. The relationship between the thickness of the overlying fabric 20 and the layer of ink 18 is such that the ink 18 does not significantly rigidify the fabric 20 and the physical and mechanical properties of the fabric 20 are dominant overall, but the layer of ink 18 does help the window 12 lie flat and hold its form.

The type of fabric 20 is not believed to be critical, so long as the ink 18 can adhere to it. In some embodiments, the fabric 20 may be made of a natural fiber, like cotton. In other embodiments, the fabric 20 may be a blend of natural and synthetic fibers. For example, the fabric 20 may be a bamboo fiber/viscose (rayon)/LYCRA® elastomer blend or a cotton/viscose (rayon) blend. Other fibers and fabrics, like polyester and linen, may be used, depending on the nature of the garment 10 and the nature of the fabric 20. For example, if the garment 10 is a pair of jeans, the fabric 20 may be denim or a denim/elastomer blend. Similarly, if the garment 10 comprises leggings, the fabric 20 may be, e.g., a nylon/elastomer blend.

The ink itself may be, for example, a two part system, such as the IMS2100 base and IMS2200 catalyst sold by Dow Corning (Midland, Mich., United States).

The ink may be printed or deposited in any conventional fashion. After deposition, if necessary or desirable, the printed garment 10 may be heat treated, left to rest for a defined period of time, or subjected to any other steps necessary to cure the ink 18 properly on the garment 10.

While the layer of ink 18 of the illustrated embodiment is generally continuous, in other embodiments, the layer of ink 18 may be patterned. In some embodiments, a layer of ink or another material may be printed or deposited below the layer of ink 18 to promote adhesion between the ink 18 and the underlying garment 10.

The window 12 of the illustrated embodiment is round, although the window 12 may be made in any shape in other embodiments, including square, rectangular, oval, or in some other polygonal form. Windows 12 may also be made in arbitrary and decorative shapes.

Any number of processes may be used to create the window or windows 12, including traditional cutting, die cutting, and punching. The window 12 may be created before or after the ink 18 is deposited. The inventors have found that laser cutting may be a particularly useful way to cut windows 12, in that it allows for both a precise edge and an arbitrary shape, and helps fuse the edges of the window 12 when used with silicone ink 18, as described below. In a typical process, the ink 18 would be applied and then the window 12 would be laser cut.

If laser cutting is to be used, the ink 18 may be applied only in the border area 16, or it may be applied across the entire area that is to be covered by the window 12 plus the border area 16. If the ink 18 is applied across the entire area to be covered by the window 12, the portion of the ink 18 inside the area of the window 12 would simply be cut away. In that case, the ink 18 would be printed in a shape such as a circle, and a smaller circle would be cut from the area of the ink 18 to form the window 12. Generally speaking, the shape in which the ink 18 is applied and the shape of the window 12 will be complementary, so that the border area 16 is at least roughly the same shape as the window 12 itself and extends substantially uniformly around it.

As was described briefly above, the silicone ink 18, in addition to acting as a non-slip agent, may act as a fusing agent in combination with laser cutting, providing a window 12 with a cut edge that is less likely to unravel. In these cases, it may be helpful to print the ink 18 before laser cutting the window 12. This results in a window 12 with a fused edge.

Figure 5:
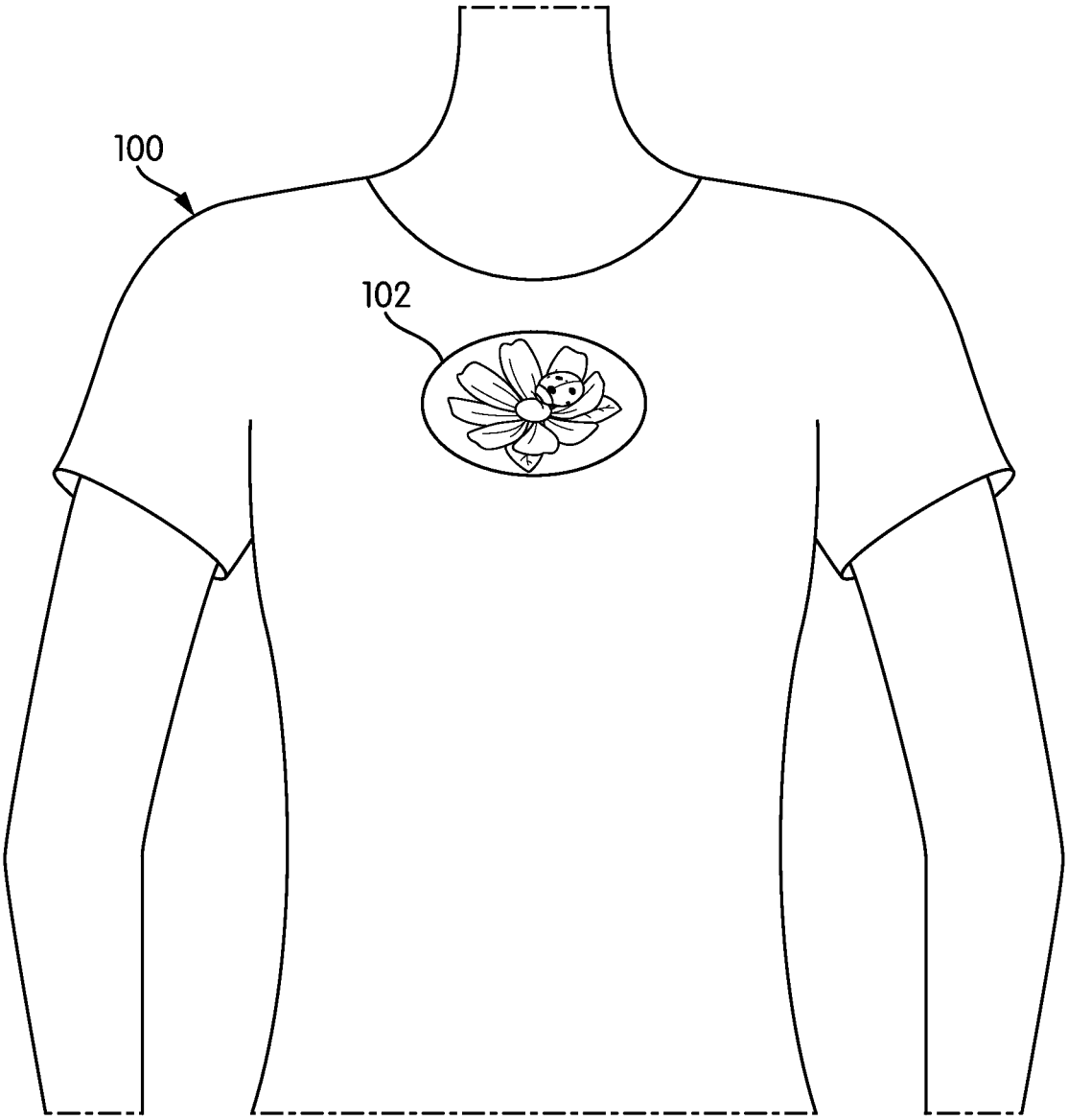
FIG. 5 is a perspective view of another embodiment of a tattoo-revealing garment with a window centered above the upper chest.
Figure 6:
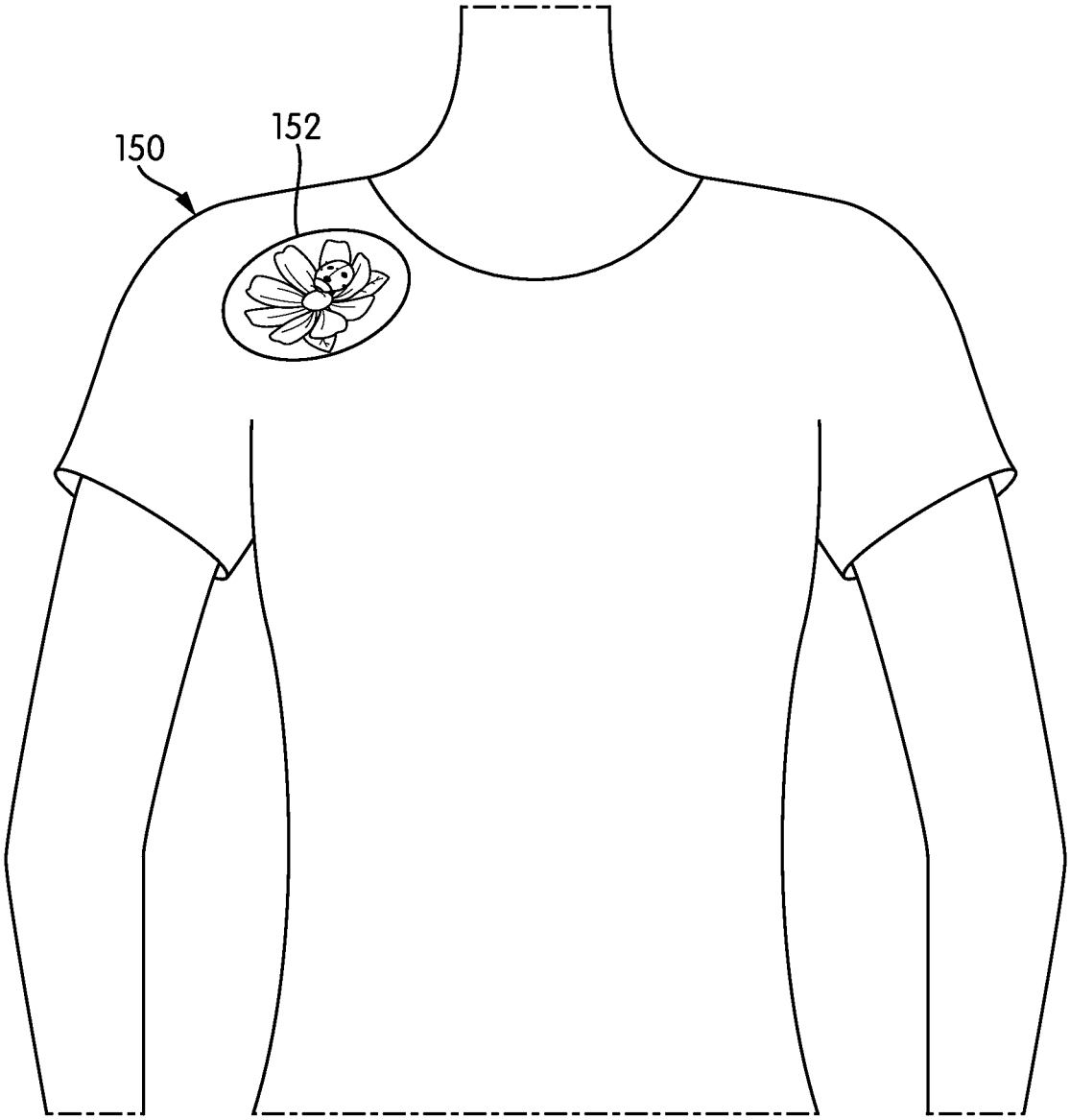
FIG. 6 is a perspective view of yet another embodiment of a tattoo-revealing garment with a window positioned above one breast.

As was described above, windows 12 may be placed in different locations. FIG. 5 is a perspective view of another embodiment of a garment 100 with a window 102 centered over the upper chest. Similarly, FIG. 6 is a perspective view of yet another embodiment of a garment 150 with a window 152 positioned over one breast. The windows 150, 152 may be round in an unstretched state, but during wear, the windows 150, 152 may stretch to a more oblong shape. If the garment is a shirt, windows may also be provided in other locations, like the upper back. If the garment is a pair of pants or leggings, a window may be provided, for example, on the side of the calf or the front of the thigh, to name a few options.

While the invention has been described with respect to certain embodiments, the description is intended to be exemplary, rather than limiting. Modifications and changes may be made within the scope of the invention, which is defined by the claims.

What is claimed is:

1. A tattoo-revealing garment, comprising:

a garment that defines at least one opening or window;

a border of silicone ink arranged around and immediately abutting the window, the border being positioned only on an underside of the at least one opening or window;

wherein the border has a width of at least about 0.125 inches.

2. The garment of claim 1, wherein the border has a width from about 0.125 inches to about 0.5 inches.

3. The garment of claim 2, wherein the border has a width of about 0.25 inches.

4. The garment of claim 1, wherein the garment is a t-shirt.

5. The garment of claim 1, wherein the garment is a shirt and the at least one opening or window is centered on an upper chest portion of the shirt.

6. The garment of claim 1, wherein the garment is a shirt and the at least one opening or window is located over a right or left breast portion of the shirt.

7. The garment of claim 1, wherein the at least one opening or window is substantially round.

8. The garment of claim 1, wherein the border has a substantially fused edge immediately abutting the window.

9. The garment of claim 1, wherein the silicone ink has a thickness in the range of about 1-2 mm.

10. A kit, comprising:

a tattoo-revealing garment including a garment that defines at least one opening or window, and a border of silicone ink arranged around and immediately abutting the window, the border being positioned only on an underside of the at least one opening or window and having a width from about 0.125 inches to about 0.5 inches; and a piece of temporary body art sized to be displayed on skin within the at least one opening or window.

11. The kit of claim 10, wherein the border of silicone ink arranged around and immediately abutting the window of the garment acts as a fusing agent, and prevents fibers of the garment from unraveling.

12. The kit of claim 11, wherein the border of silicone ink printed on the inside of the garment provides grip or increased friction against the underlying skin so as to maintain the opening or window in place against skin.

13. The garment of claim 11, wherein the border of silicone ink is continuous.

14. The garment of claim 11, wherein the border of silicone ink is patterned.

15. The garment of claim 11, wherein a base layer is printed or deposited below the border of silicone ink to promote adhesion between the ink and the underlying garment.

16. A method of wearing a tattoo-revealing garment, comprising:

wearing a garment that includes at least one opening or window with a border of silicone abutting the opening or window, the border having a width of at least about 0.125 inches, such that (1) the border is only positioned on an underside of the at least one opening or window and is not visible from an exterior side of the garment; and (2) a piece of body art on skin bordered by the opening or window is visible through the opening or window.

17. The method of wearing a tattoo-revealing garment of claim 16, wherein the piece of body art is temporary and the method further comprises applying the piece of temporary body art within the opening or window.

18. A tattoo-revealing garment, comprising:

at least one substantially rounded opening or window; and a border of silicone ink having a thickness in a range from about 1-2 mm arranged around and immediately abutting the opening or window on only one side thereof, such that (1) the border is not visible from an exterior side of the garment when it is worn, and (2) an edge of the garment and an edge of the border have a jointly fused edge, the border having a width from about 0.125 inches to about 0.5 inches.

19. The tattoo-revealing garment of claim 18, wherein the garment is a shirt.

20. The tattoo-revealing shirt of claim 19, wherein the at least one opening or window is located on a sleeve, centered on the chest, or above a breast portion.

* * * * *